US007143971B2

(12) United States Patent
Yoder et al.

(10) Patent No.: US 7,143,971 B2
(45) Date of Patent: Dec. 5, 2006

(54) FENCE ROLLING APPARATUS AND METHODS

(75) Inventors: Sylvan Yoder, 145 Jacks Mountain Rd., McVeytown, PA (US) 17051; John Herr, New Holland, PA (US)

(73) Assignee: Sylvan Yoder, McVeytown, PA (US)

( * ) Notice: Subject to any disclaimer, the term of this patent is extended or adjusted under 35 U.S.C. 154(b) by 258 days.

(21) Appl. No.: 10/774,795

(22) Filed: Feb. 9, 2004

(65) Prior Publication Data

US 2004/0227031 A1 Nov. 18, 2004

Related U.S. Application Data

(60) Provisional application No. 60/445,789, filed on Feb. 7, 2003.

(51) Int. Cl.
*B65H 75/48* (2006.01)

(52) U.S. Cl. ..... 242/390; 242/394; 242/397.5; 242/419.5; 242/396

(58) Field of Classification Search ..... 242/390, 242/394, 397.5, 403, 419.5, 557, 396.5, 401, 242/396

See application file for complete search history.

(56) References Cited

U.S. PATENT DOCUMENTS

| | | | | |
|---|---|---|---|---|
| 2,839,257 | A | 8/1958 | Chicane | |
| 2,912,183 | A | 11/1959 | Hull | |
| 2,914,270 | A | 11/1959 | Parker et al. | |
| 3,048,348 | A | 8/1962 | Griffin | |
| 4,333,250 | A | 6/1982 | Henderson | |
| 4,473,196 | A | 9/1984 | Sammann et al. | |
| 4,930,718 | A | 6/1990 | Lancour et al. | |
| 5,246,182 | A | 9/1993 | Lester | |
| 5,385,314 | A * | 1/1995 | Hughes | 242/397.3 |
| 5,388,782 | A | 2/1995 | King | |
| 5,582,216 | A | 12/1996 | Smith et al. | |
| 6,016,986 | A | 1/2000 | Wright | |
| 6,042,046 | A | 3/2000 | Beyer, Sr. | |
| 6,503,326 | B1 * | 1/2003 | Mikelionis | 118/419 |
| 6,543,713 | B1 * | 4/2003 | Frolander et al. | 242/399.1 |

* cited by examiner

*Primary Examiner*—John Q. Nguyen
(74) *Attorney, Agent, or Firm*—McNees Wallace & Nurick LLC

(57) ABSTRACT

The present invention is directed toward apparatus and methods for rolling and distribution of fencing material, and is particularly suited for flexible fencing such as metal and plastic fencing, whether linked, boxed, webbed, barbed, electrified, or otherwise configured. The apparatus of the invention can be mounted on a skid loader, tractor, or other lifting vehicle, whether onto the bucket attachment or onto the forklift attachment of such a lifting vehicle. The apparatus has a wrapping shaft that is pivotally or hingedly mounted to supporting framework. The shaft is connected to a motor for powered rotation of the shaft. The apparatus also has one or more tensioning rollers that flatten the fencing and position it during uptake or distribution of fencing by the wrapping roller. The supporting framework has guides that orient and position the fencing as it passes through the apparatus. The invention also provides methods of recovering, as well as distributing, fencing using the apparatus.

23 Claims, 13 Drawing Sheets

FENCE ROLLING APPARATUS AND METHODS

CROSS REFERENCE TO RELATED APPLICATIONS

This application claims priority to U.S. Provisional Patent Application No. 60/445,789 filed Feb. 7, 2003, which application is hereby incorporated by reference.

BACKGROUND OF THE INVENTION

This invention relates to rolling and distribution of flexible elongated materials such as fencing, wire, and cable, and more particularly, to apparatus and methods for rolling and distributing fencing for easy use, re-use, recycling, and/or disposal.

Flexible elongated material, such as metal and plastic fencing, barbed wire, and electric cable, is widely used to enclose or divide properties. In agricultural and wildlife preservation applications, fences may be several miles long. For example, metal box fencing is used in game lands in the state of Pennsylvania and elsewhere to enclose large areas to exclude deer populations from decimating newly reforested areas. After several years, when the reforested area has matured, the fencing is removed to allow deer to repatriate the area.

While apparatus and methods are prevalent for installation of flexible fencing, fence removal apparatus and methods for the most part remain primitive, involving strenuous and tedious manual labor. Known manual methods require manual removal of fencing from support posts, and loose hand-rolling, cutting, and gathering of fencing material for removal from the subject property. These manual removal methods render fencing unsuitable for re-use or recycling, and inconvenient for transport and disposal.

There exist known apparatus for rolling and/or distribution of fencing. For example, examples of known apparatus for attachment onto vehicles to assist in reeling and unreeling wire and fencing materials include those described in: U.S. Pat. No. 2,914,270 to Parker et al. for a "Vehicle Attached Wire Stretching and Reeling Device"; U.S. Pat. No. 3,048,348 to Griffin for a "Wire Fencing Stringing and Stretching Implement"; U.S. Pat. No. 3,934,655 to Whistle for a "Hydraulic Post Setting and Wire Dispensing Apparatus"; U.S. Pat. No. 2,839,257 to Chicane for a "Wire Reel"; U.S. Pat. No. 4,775,114 to Farnsworth for a "Fencing Wire Unwinder and Tensioner"; U.S. Pat. No. 4,925,435 to Linklater for an "Apparatus for Winding and Unwinding Wire"; U.S. Pat. No. 4,930,718 to Lancour et al. for a "Fencing Dispenser"; U.S. Pat. No. 5,163,634 to Moon et al. for a "Fence Stretching Apparatus"; U.S. Pat. No. 5,388,782 to King for an "Apparatus for Winding Fence Material"; and U.S. Pat. No. 6,042,046 to Beyer for "Reeling and Unreeling Apparatus, System, and Method."

The above-mentioned Chicane, Farnsworth, Linklater, and Whistle patents disclose attachments that are capable of unwinding one or more reels of stranded wire only. The inventions disclosed in the above mentioned patents to Parker et al., Griffin, Lancour et al., Moon et al. and King are designed to unroll reels of woven wire fencing material. However, King does not allow the fencing material to be unreeled from a vertical orientation; therefore, the fencing material has to be lifted in a separate step to utilize it for fencing purposes. The King, Parker et al., Lancour et al. and Moon et al. devices do not allow for the unreeling of individual strands of wire such as would be necessary in the construction of a barbed wire fence. The Griffin device does provide for the addition of a single spool of barbed wire to be unreeled simultaneously with the reel of fencing material. Of the patents discussed above, only the Parker et al., Lancour et al., and Beyer patents disclose attachments that allow for the tilting of the apparatus necessary for ease of loading the device with a reel of fencing material. The Parker et al. device additionally provides a means for lowering a spindle for insertion through the center of a reel of fencing material, but requires that the lift arms of a three-point hitch of a tractor be used to raise and lower the spindle. The Lancour et al. patent discloses a fencing dispenser wherein a reel of fencing material is placed within a cage-like structure that can be lowered by means of a hydraulic cylinder. Notably, the Lancour et al. device does not have a shaft or spindle to support the fencing reel, rather it allows the reel to move freely within the cage to form a loose and uneven roll of fencing. The Beyer apparatus provides for winch-assisted tilting of the powered rotatable shaft for loading or unloading of wire, and also provides for placement of a number of vertically spaced fencing materials on the shaft for simultaneous distribution of strand-type fencing. However, the Breyer apparatus does not include any means for flattening, tensioning guiding, and positioning of the wire as it is retrieved or dispensed.

The above-described apparatus do not solve several problems that persist in the art of fencing recovery and distribution. Specifically, none of the above apparatus provide adequate means for flattening, tensioning, guiding, and positioning of fencing materials as they are retrieved onto, or distributed from, a wrapping shaft. Moreover, none of the apparatus include a supporting frame that allows for easy attachment directly to the bucket connection of an all-terrain skidloader, tractor loader, or backhoe, as well as onto the forklift attachment of any materials transfer or lifting vehicle. For these reasons, there is a continuing need for an apparatus that allows the tensioned reeling and unreeling of woven fencing material concurrently with a plurality of barbed wire strands, or any combination of various woven and strand-type fencing materials. There further exists a continuing and long-felt need for an apparatus and automated methods of fence removal that provide for tightly and evenly wound fencing for easy and efficient distribution, use, removal, re-use, recycling, and/or disposal.

SUMMARY OF THE INVENTION

An apparatus is provided for automated rolling and distribution of flexible elongated material. The apparatus includes a supporting framework having means for attachment of the apparatus to the lift mechanism of a motorized vehicle, a motor connected to a wrapping shaft. The wrapping shaft as a first end and an opposite second end, the first end mounted to the supporting framework by mounting means, the second end removably connected to the motor for powered rotation of the wrapping shaft by the motor. The apparatus also includes at least one tensioning roller that is substantially cylindrical, and is rotatably mounted to the supporting framework in substantially parallel orientation to the at least one wrapping shaft.

A first method is provided for rolling flexible elongated material using the apparatus. The method involves the steps of: providing at least one unrolled elongated flexible material, providing an apparatus having a supporting framework, a motor mounted to the supporting framework, a wrapping shaft mounted to the supporting framework and connected to the motor for selected powered rotation of the wrapping shaft, and at least one tensioning roller mounted to the supporting framework. The method requires the steps of threading an unencumbered edge of the at least one elongated flexible material over the at least one tensioning roller, removably attaching the unencumbered edge to the wrapping shaft; and operating the motor to engage and rotate the wrapping shaft so as to retrieve the unrolled flexible material and roll the material around the rotating shaft.

A second method is provided for distributing rolled flexible elongated material. The second method involves the steps of providing rolled elongated flexible material; providing an apparatus having a supporting framework, a motor mounted to the supporting framework, a wrapping shaft mounted to the supporting framework and connected to the motor for selected powered rotation of the wrapping shaft, and at least one tensioning roller mounted to the supporting framework. The method requires the steps of placing the rolled flexible material on the shaft of the apparatus, threading an unencumbered edge of the elongated flexible material over the at least one tensioning roller; applying tension to the leading edge, and operating the motor to rotate the wrapping shaft so as to distribute the rolled flexible material.

The present invention is directed toward apparatus and methods for rolling and distribution of fencing material, and is particularly suited for flexible fencing such as metal and plastic fencing, whether linked, boxed, webbed, barbed, electrified, or otherwise configured. The apparatus of the invention is comprised of a mechanical assembly that can be mounted on a skid loader, tractor, or other lifting vehicle, whether onto the bucket attachment or onto the forklift attachment of such a lifting vehicle.

As further described herein, the mechanical assembly includes a supporting framework that supports one or more wrapping shafts. Each wrapping shaft is connected to a motor, which motor provides for powered rotation of the wrapping shaft. Preferably, one end of the wrapping shaft is pivotally or hingedly mounted to the supporting framework. Preferably, the apparatus is further comprised of one or more tensioning rollers which flatten the fencing and position it for uptake by the wrapping roller. The framework may further comprise guides that orient and position the fencing as it passes through the apparatus. The guides may be fixed or adjustable. In any embodiment, the apparatus produces a tightly wrapped roll of recovered fencing that can easily be removed from the apparatus for transport, re-use, recycling, storage, or disposal.

DETAILED DESCRIPTION OF THE PREFERRED EMBODIMENTS

Figure 6:
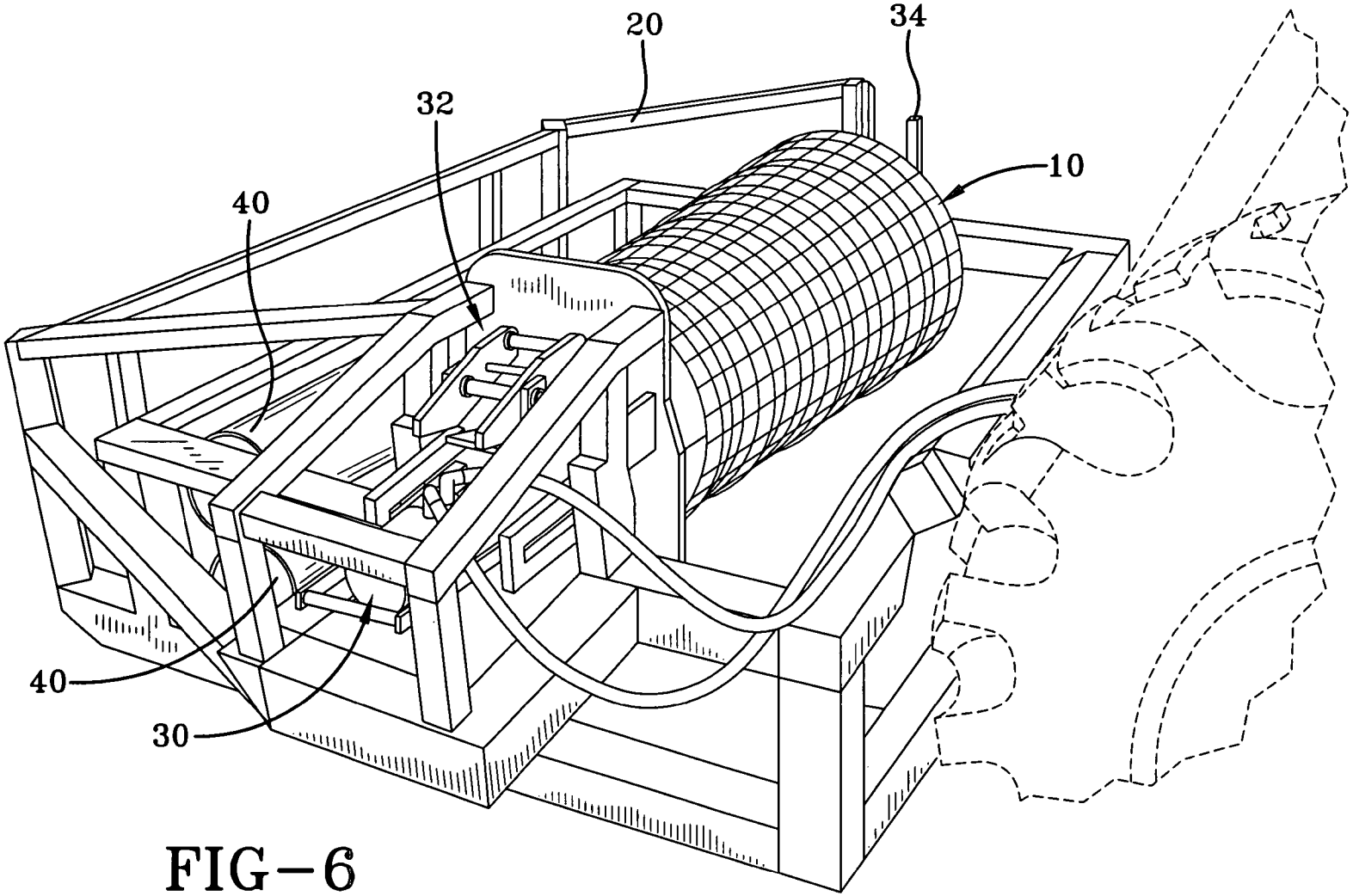
FIG. 6 illustrates a side perspective view of the apparatus of the embodiment of FIG. 1 of the present invention mounted on a skid loader, with the rolling of a box fence section completed.

The apparatus of the present invention is comprised of a supporting framework that can be easily and removably mounted onto a variety of material handling vehicles and other lifting equipment such as, but not limited to, backhoes, tractors, skid loaders, all-terrain vehicles, trucks, and the like. By way of example, FIG. 6 illustrates a side perspective view of a first embodiment of the apparatus of the present invention mounted on a Case® brand all-terrain skid loader, showing the supporting framework mounting assembly attached to the skid attachment points on the skid loader. Case® is a registered trademark for use with tractors, skid engines and the like, and is owned by CASE CORPORATION OF DELAWARE with a place of business located at 700 State Street, Racine, Wis. 53404. While an all-terrain vehicle such as the Case® skid loader or a tractor is preferred, any motorized vehicle having a lift apparatus such as a bucket attachment, forks, or a hitch mechanism can be used to support, maneuver, and operate the apparatus of the preset invention. Preferably, the vehicle has auxiliary hydraulic, electric, or pneumatic power attachments for powering the motor of the apparatus.

Figure 1:
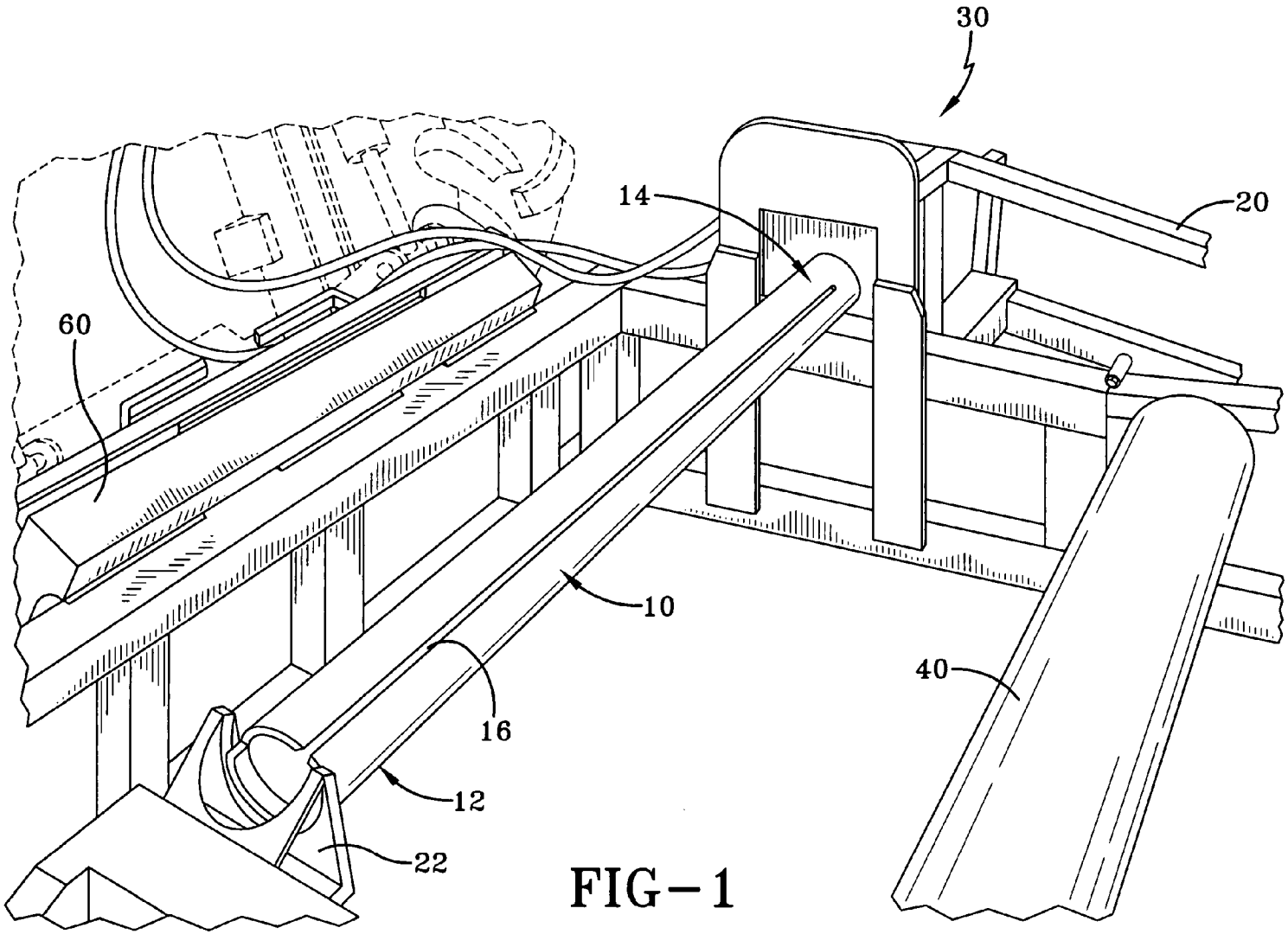
FIG. 1. illustrates a partial perspective view of a wrapping shaft in accordance with a first embodiment of the present invention.

The apparatus of the invention includes at least one wrapping shaft to receive, retain, roll, and distribute flexible elongated materials (hereinafter generally referred to as fencing). In the first embodiment shown in FIG. 1, the wrapping shaft 10 is comprised of an axially longitudinally mounted elongated cylinder. At least one end of the shaft 10 is pivotally mounted to the supporting framework 20. In the embodiment of FIG. 1, a first end 12 of the shaft 10 is supported by a removable attachment means 22, such as a u-shaped bearing, end pin, or sleeve that can be disengaged from the first end 12 to render the first end 12 unencumbered and free to pivot about a second end 14 that is opposite the first end 12 of the shaft 10. In a first embodiment of FIG. 1, the second end 14 of the shaft 10 is connected to means for powered rotation, here shown as an electric, hydraulic, or pneumatic motor 30. However, in other embodiments, the motor 30 may engage the first end 12.

As further shown in FIG. 1, the wrapping shaft 10 contains means for receiving and retaining the leading edge of fencing at commencement of rolling operations. Such means can include a slot 16 in the cylinder surface, protruding pins or tabs that can engage the fencing, or any other means known to those skilled in the art for retaining fencing tightly against the shaft 10. As the wrapping shaft 10 is rotated, fencing is wound onto the shaft to form a roll of fencing having multiple layers, the layers provide friction between the shaft 10 and the fencing necessary to retain the fencing on the shaft 10 in a relatively fixed position.

Figure 2:
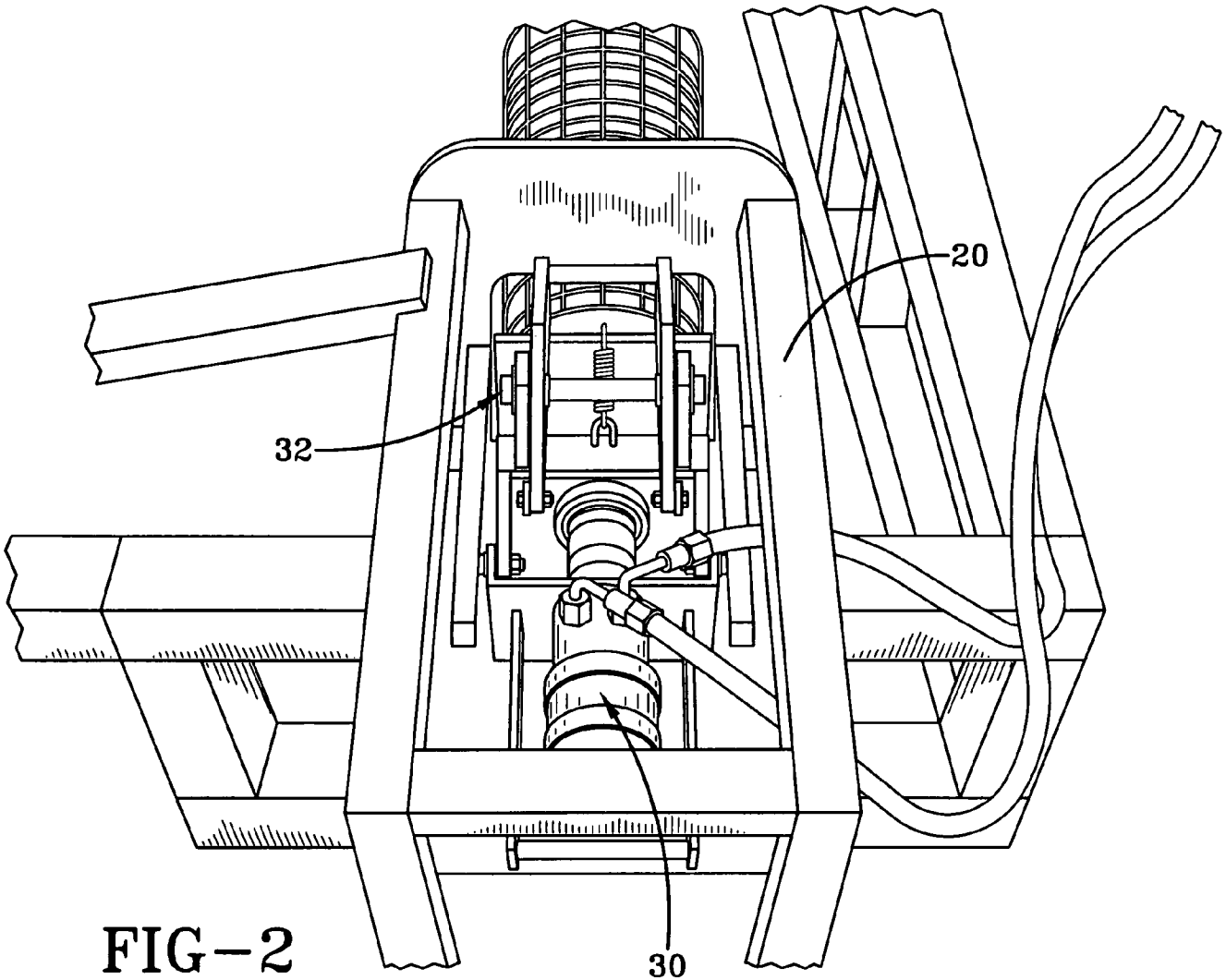
FIG. 2 illustrates a perspective view of a motor removably attached to the motor end of a wrapping shaft in accordance with the embodiment of FIG. 1 of the present invention.

FIG. 2 illustrates a perspective view of the motor 30, which is connected to the second end 14 of the wrapping shaft 10 in accordance with the first embodiment of the present invention. The motor 30 may be of any type, including, but not limited to, electric, gasoline, magnetic, pneumatic, or hydraulic. In the embodiment shown in FIG. 2, the motor 30 is hydraulic, and is powered by the skid loader and controlled by the skid loader operator. As further described with respect to FIG. 7, the motor 30 can be easily disengaged, moved or removed from its shaft connection for unloading or loading of wrapped fencing.

Figure 3:
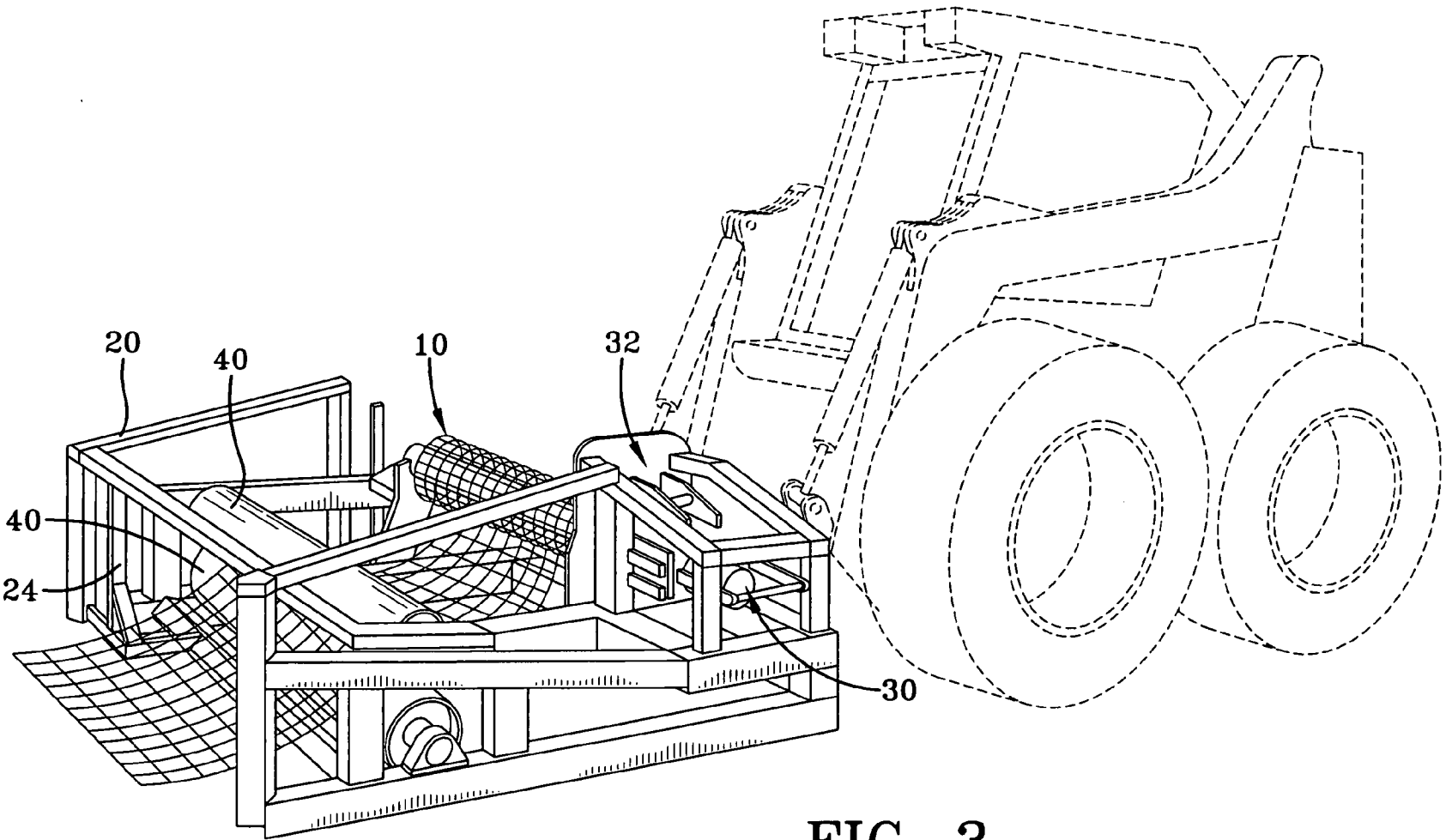
FIG. 3 illustrates a reduced perspective view of the embodiment of FIG. 1 of the apparatus of the present invention mounted on a skid loader, with the apparatus actively engaged in retrieving and rolling a long section of 4 foot-wide metal box fence.
Figure 4:
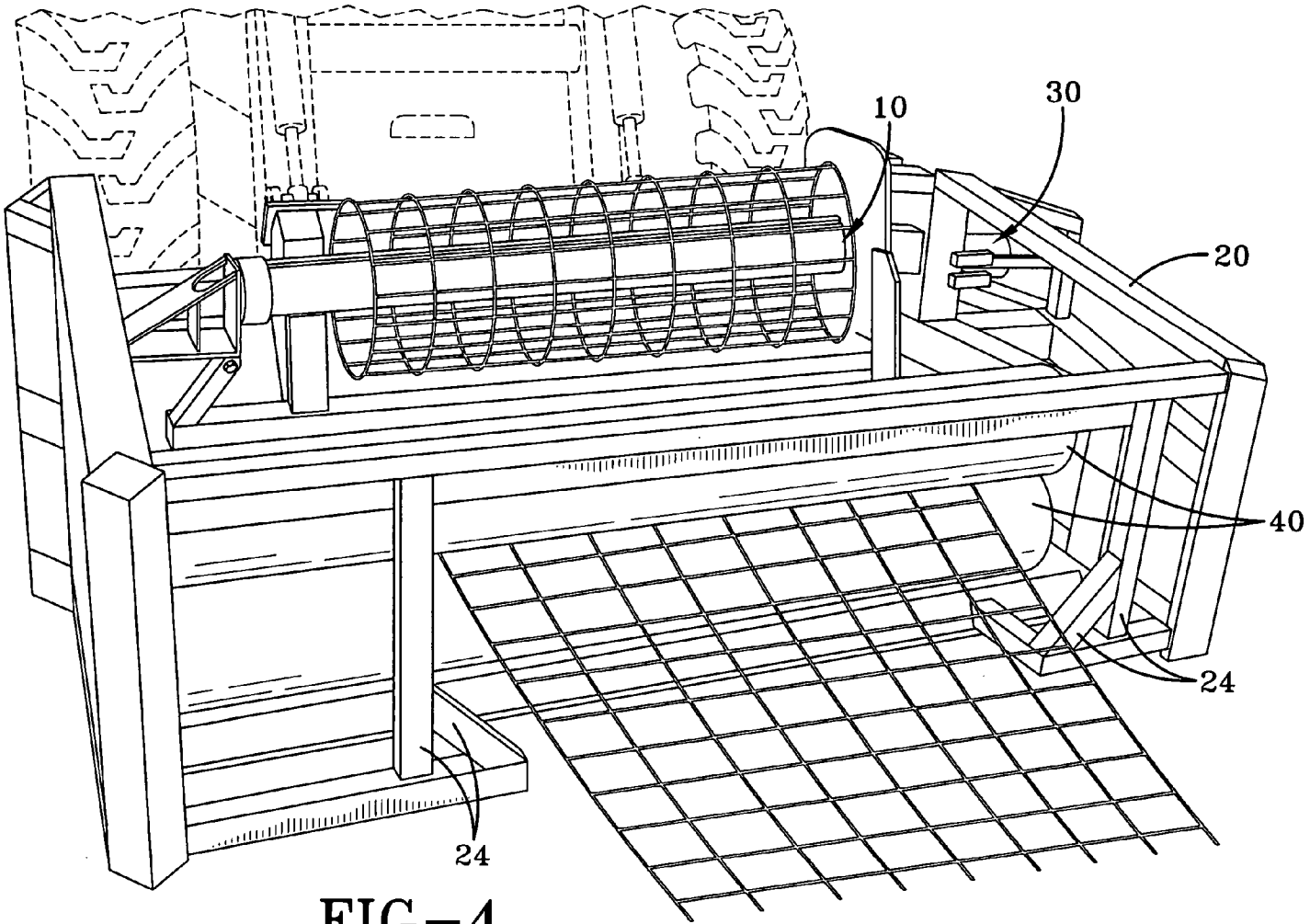
FIG. 4 illustrates an enlarged perspective view of the apparatus of the embodiment of FIG. 1 of the present invention mounted on a skid loader, with the apparatus actively engaged in retrieving and rolling a long section of metal box fence through two tensioning rollers and onto the wrapping roller. Framework guides are also shown.

As shown in FIG. 3, the apparatus can be easily and removably mounted to a variety of motorized vehicles. FIG. 3 illustrates a side perspective view of a particular embodiment of the present invention mounted on a skid loader, with the apparatus actively engaged in retrieving and rolling a long section of 4 foot-wide metal box fence. FIG. 4 illustrates a front perspective view of the same embodiment, with the apparatus actively engaged in retrieving and rolling a long section of 4 foot-wide metal box fencing. The fencing is drawn across at least one tensioning roller 40 prior to meeting the wrapping shaft 10. In the embodiment illustrated in FIG. 4, the at least one tensioning roller 40 is comprised of two opposed tensioning rollers 40. In a single tensioning roller embodiment, the fencing would be drawn between the tensioning roller 40 and a fixed plate or horizontal member on the supporting framework 20 to flatten and tension the fencing. In any embodiment, the tensioning roller(s) 40 exert pressure to flatten the fencing to near-new condition, while also creating the tension necessary for tight wrapping. Any or all of the tensioning rollers 40 may be mounted to the supporting framework 20 using dynamic tension means, such as, but not limited to, spring-loaded mountings, mountings with rubber or polyurethane inserts, or hydraulic mountings and the like in order to dynamically, flexibly, and adjustably maintain pressure and tension on fencing during rolling and distributing operations. Additionally, to ensure alignment of the fencing onto the wrapping shaft 10, guides 24 may be provided. As shown in FIG. 4, guides 24 are preferably mounted onto the supporting framework 20 in both vertical orientation, as well as at angles between vertical and horizontal orientation to guide the fencing into the rollers 40.

Figure 5:
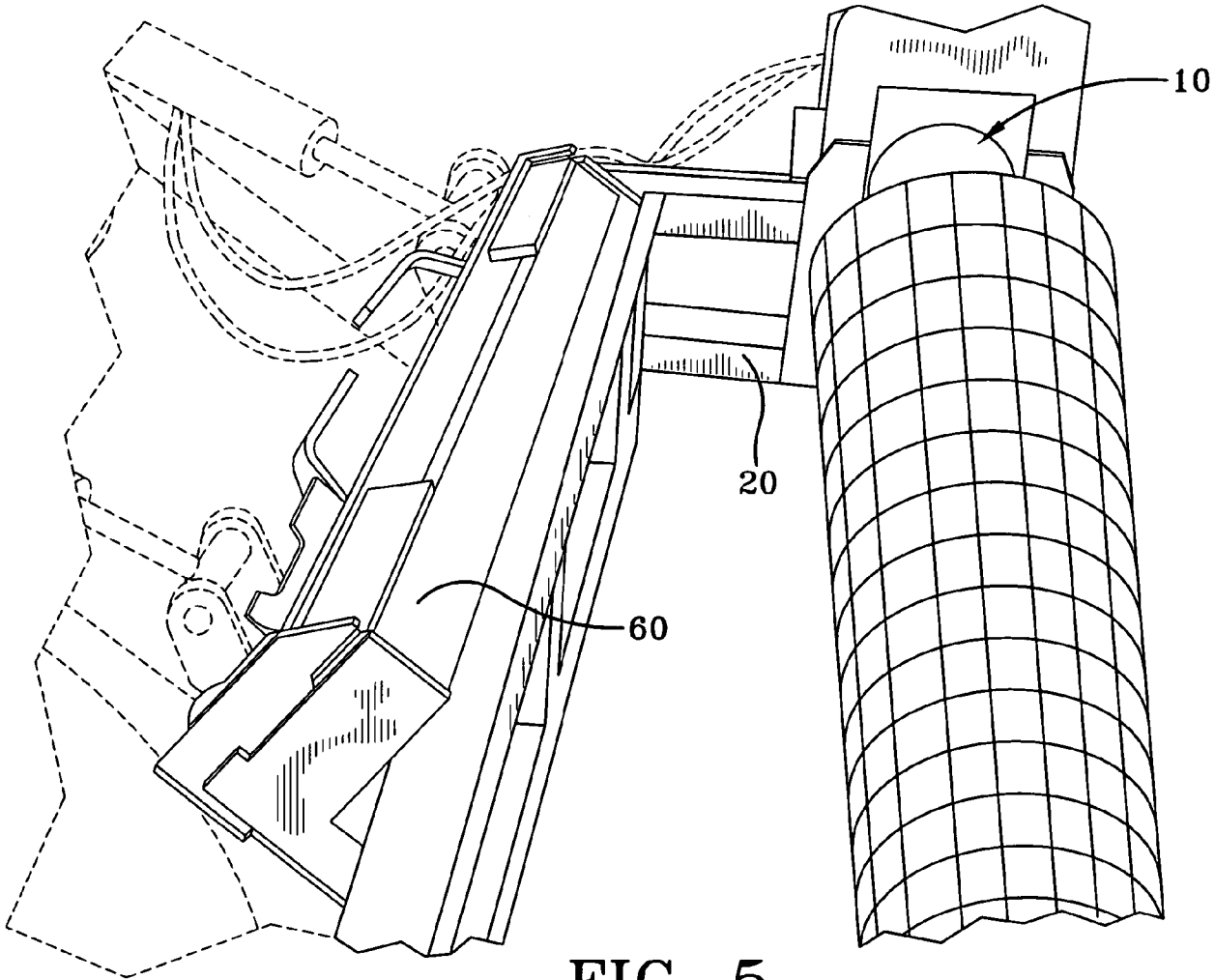
FIG. 5 illustrates a side perspective view of the apparatus of the embodiment of FIG. 1 of the present invention mounted on a skid loader, showing the supporting framework mounting assembly attached to the skid attachment points on the skid loader.
Figure 7:
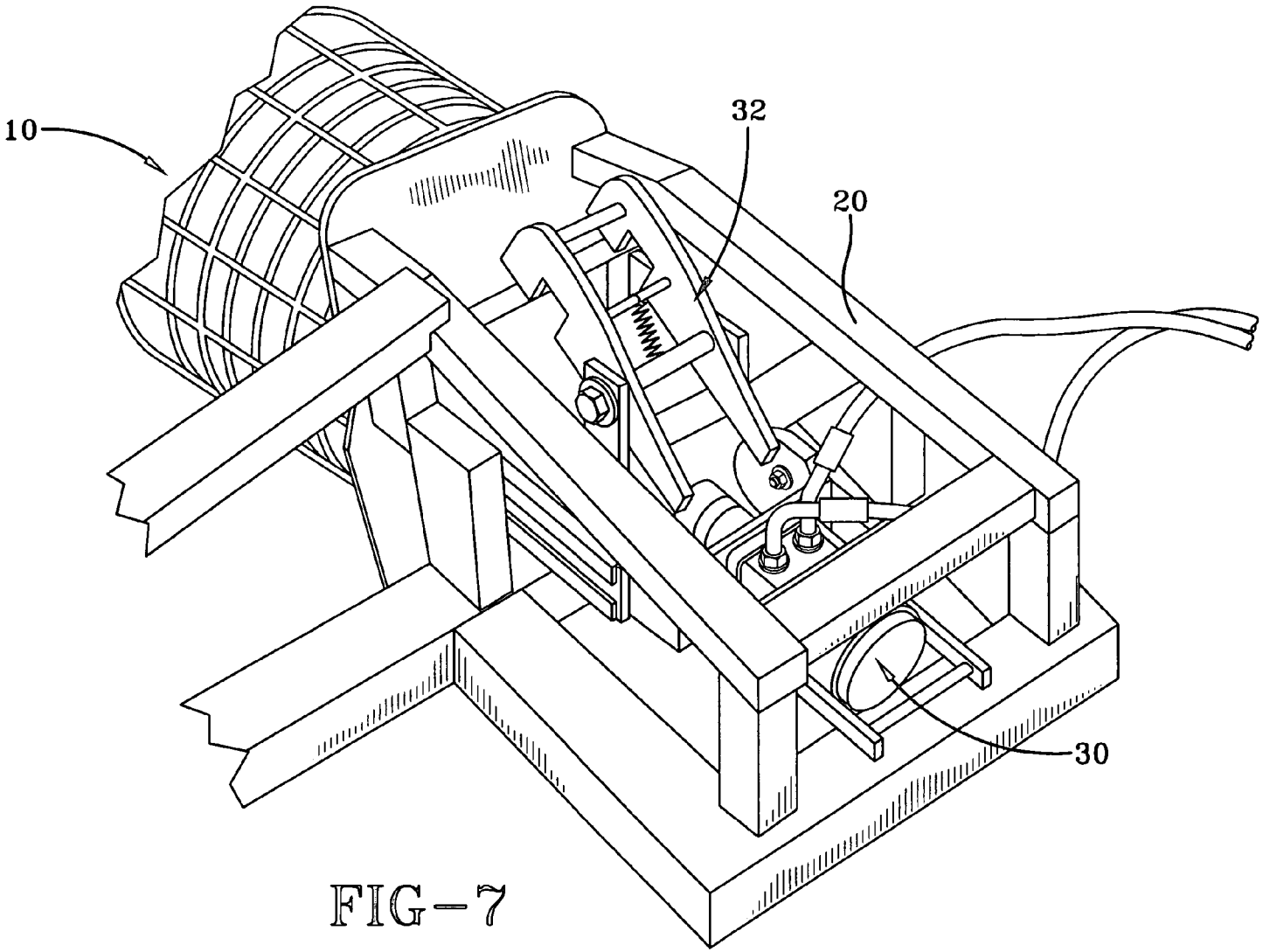
FIG. 7 illustrates an embodiment of the removable motor mount of the embodiment of FIG. 1 in accordance with the present invention.
Figure 8:
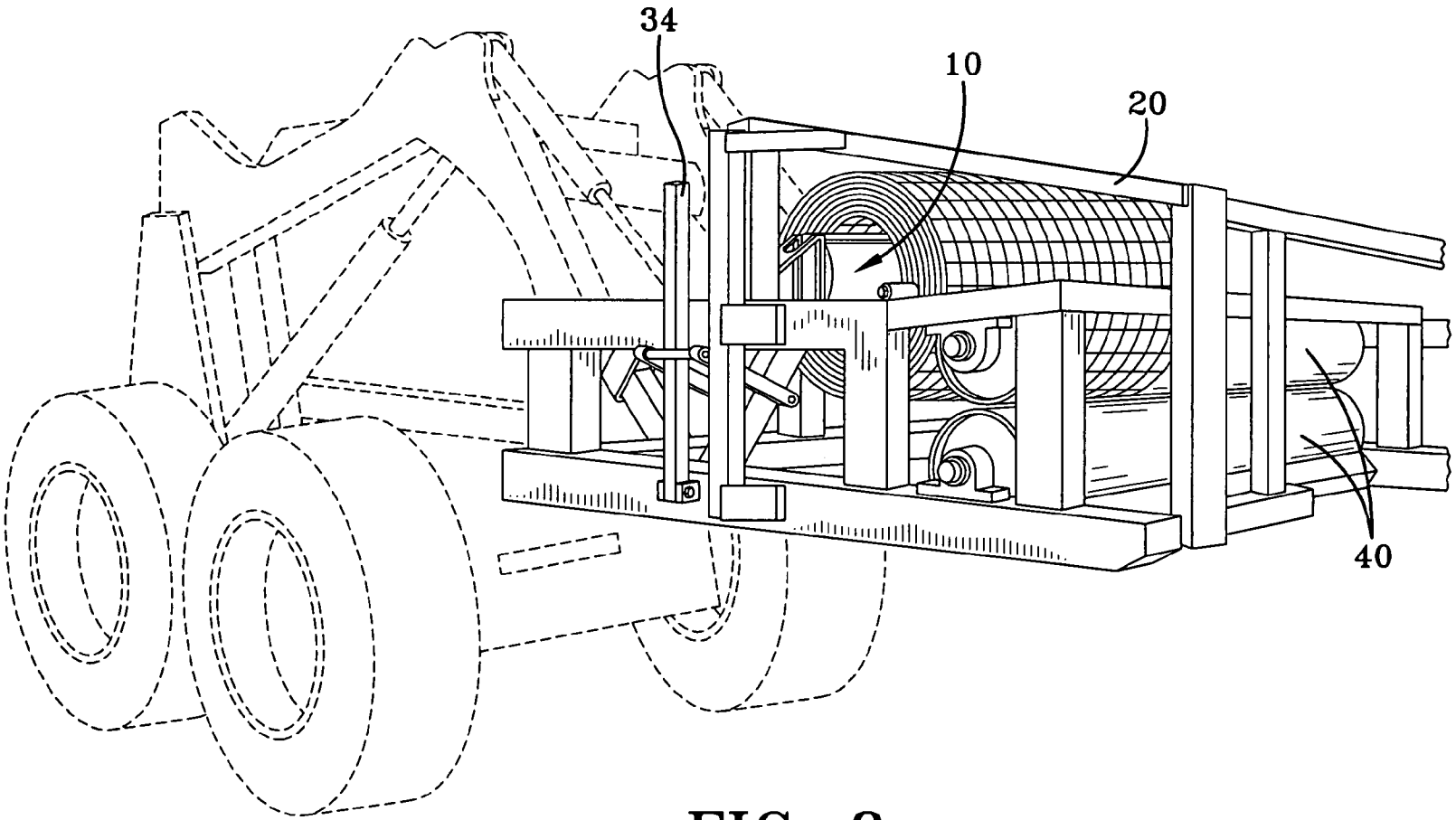
FIGS. 8–9 illustrate the apparatus of the embodiment of FIG. 1 being elevated by the skid loader to facilitate removal of the wrapped fencing from the wrapping roller, and operation of a lever which removes the wrapping shaft support bearing, thus removing support of the non-motor end of the wrapping shaft.
Figure 9:
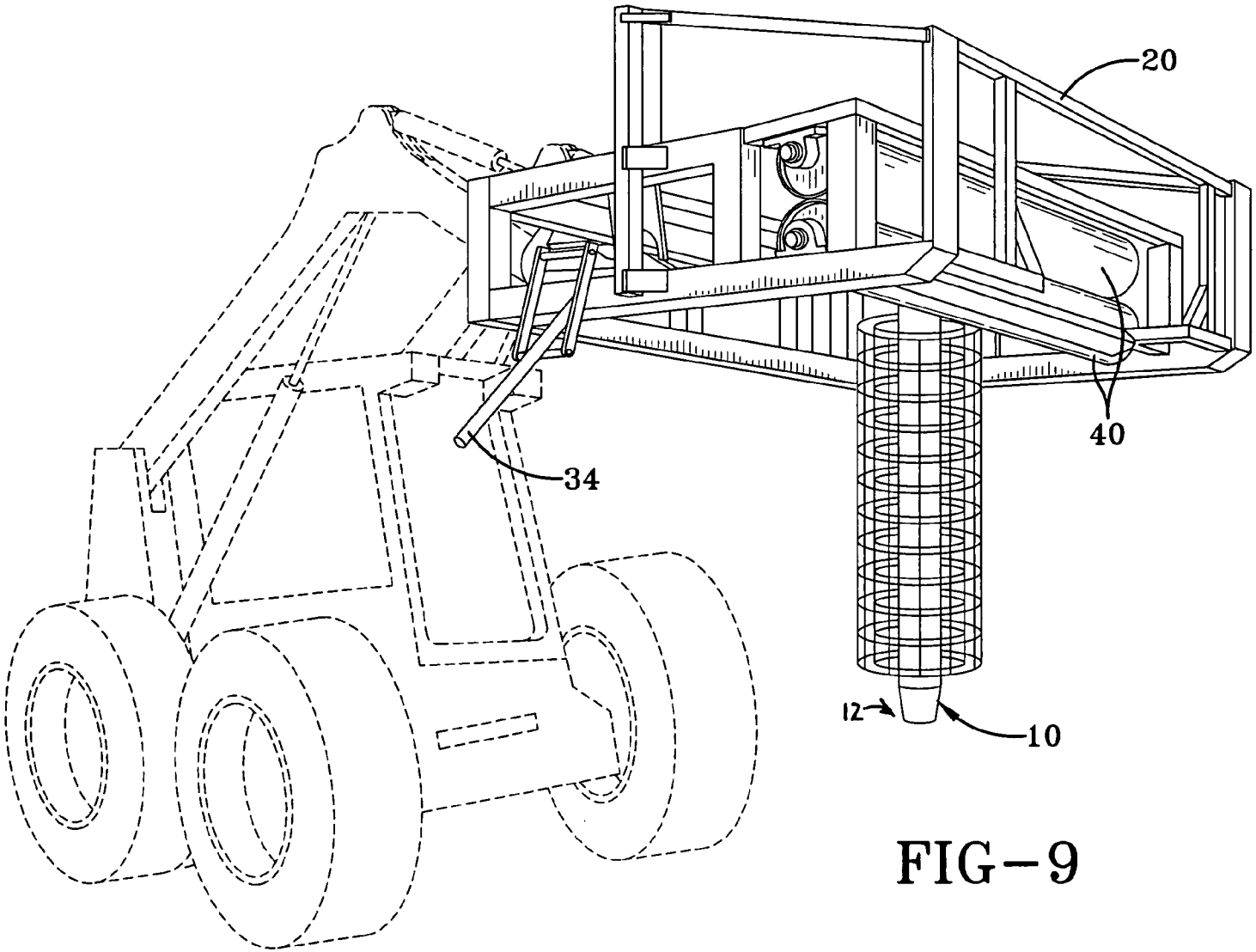

Rolling of fencing onto the wrapping shaft 10 is controlled by operation of the motor 30. Preferably, the speed of the motor 30 is variable, and can be adjusted by the operator to maximize tension, roll size, and other associated fencing parameters. FIG. 5 and FIG. 6 show the apparatus during rolling operations involving a section of box fence on the wrapping shaft 10. As shown in FIG. 5, the apparatus includes one or more mounting plate(s) 60 configured for easy attachment to the lift mechanism of a powered lift vehicle. As shown in FIGS. 8–9, to facilitate removal of the rolled fencing from the wrapping shaft 10, the apparatus is elevated by the lift vehicle to allow pivoting of the wrapping shaft 10 into a vertical position. In the first embodiment, to allow pivoting of the shaft 10, the motor mount assembly 32 must be operated to disconnect from the wrapping shaft 10. As shown in FIGS. 6–7, this is preferably accomplished by lifting or otherwise operating of a lever connected to the motor mount 32, thus permitting the motor 30 to slide away from the shaft 10, disengaging the motor 30 from the second end 14. In this first embodiment, the wrapping shaft 10 preferably remains pivotally connected to the supporting framework 20 at the second end 14 of the shaft 10 adjacent the motor 30. However, as in the second embodiment further described below, the first end 12 may be pivotally mounted on the supporting framework 20 opposite the motor 30, thus allowing the second end 14 to be removeably unencumbered, without departing from the contemplated invention.

Figure 10:
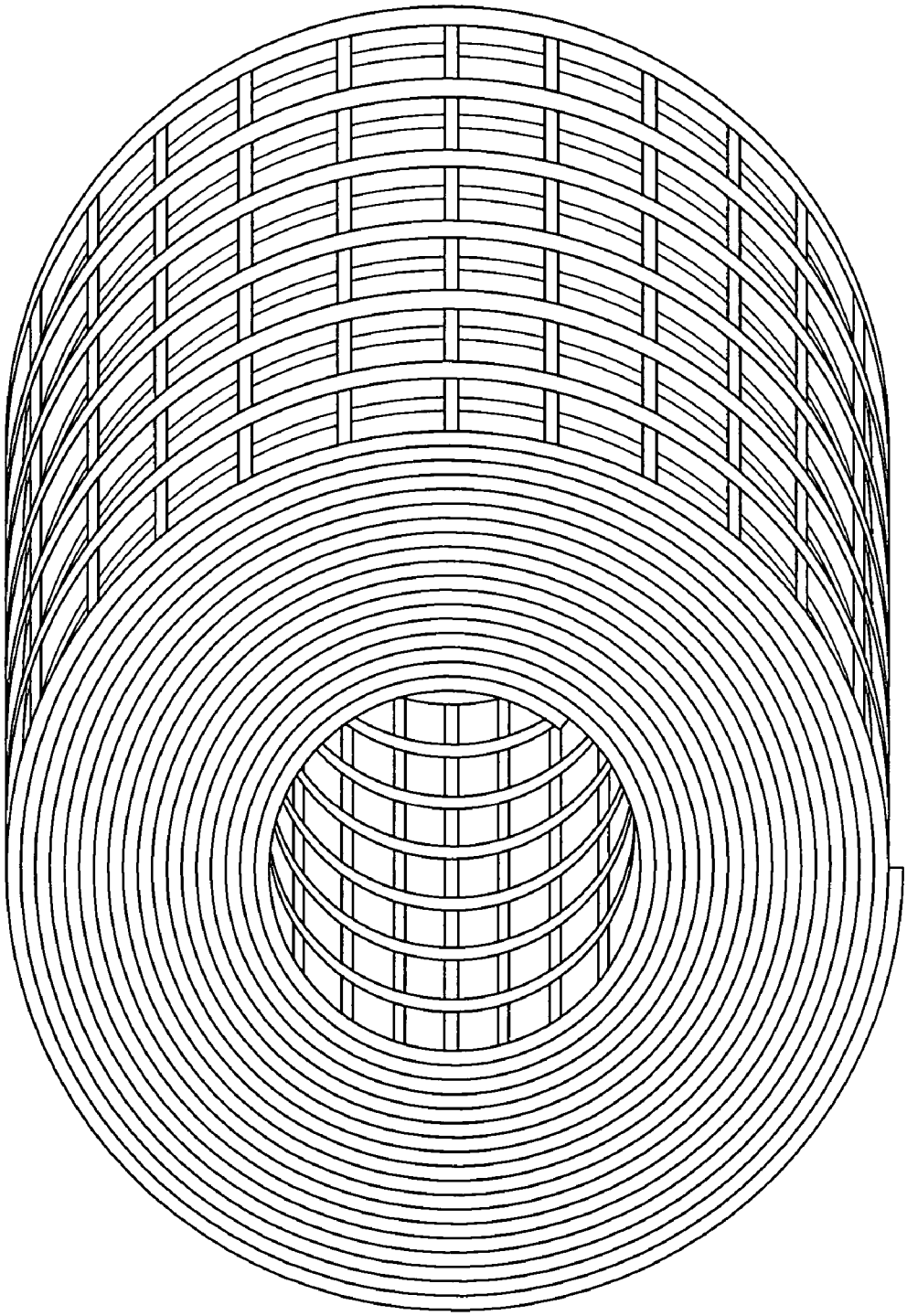
FIG. 10 illustrates fencing recovered using the apparatus of the present invention.

For unloading and loading in the first embodiment, the unencumbered end, here the first end 12, of the wrapping shaft 10 must be disconnected from the removable attachment means 22 to allow pivoting of the shaft 10 about its attachment to the supporting framework 20. For example, as shown in FIGS. 8–9, the shaft can be disconnected by the operation of a lever 34 which engages the removable attachment means 22 of FIG. 1, shown as a wrapping shaft support bearing 26, thus removing support of the first unencumbered end 12 of the wrapping shaft 10. In this embodiment, operation of the lever 34 disconnects the shaft 10 from the removable attachment means, causing the wrapping shaft 10 and the rolled fencing to pivot into a vertical position for easy unloading of the wrapped fencing. As shown in FIG. 10, the recovered fencing is tightly wrapped in a cylindrical configuration, and the roll ends are substantially aligned—very much like new rolls of flexible fencing.

Figure 13:
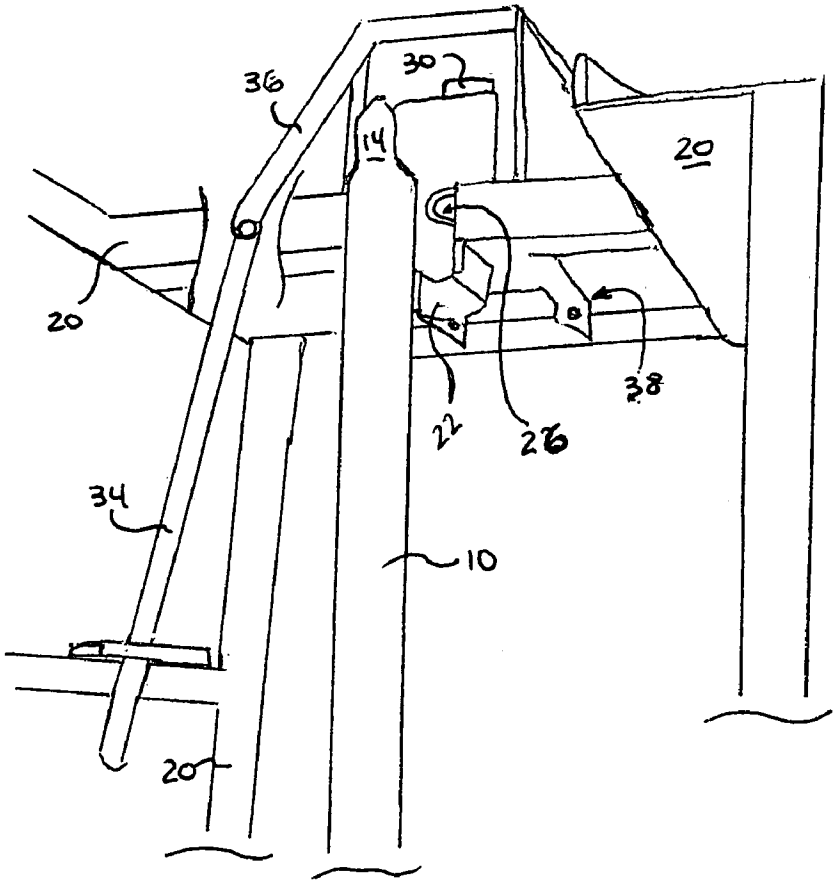
FIG. 13 illustrates an enlarged partial side perspective view of the apparatus of FIG. 11.

In a second preferred embodiment illustrated in FIGS. 11–14, the apparatus includes novel features and elements disclosed in the first embodiment, but is orientated and configured to roll fencing in a vertical or upright orientation, rather than in a horizontal orientation. Accordingly, as shown in FIGS. 11–14, in this second embodiment the wrapping shaft 10 and tensioning rollers 40 are disposed in a substantially vertical orientation that is generally perpendicular to the ground. In this embodiment, the motor 30 is preferably mounted at the vertical top of the supporting framework 20, and therefore may require assisted mechanical means for removably engaging and disengaging the motor 30 from the wrapping shaft 10 to allow for loading and unloading of fencing. As shown in FIG. 13, the mechanical means preferably includes a lever 34 connected to motor disengaging means 36, the motor disengaging means 36 operably connected to motor connection means 26. The motor connection means 26 can include one or more support bearings, prongs, forks, springs, sliding sleeves, manual clutches, or other mechanical configurations that establishes a connection between the motor 30 and the shaft 10, here the second end 14 of the shaft 10. The motor disengaging means 36 functions to disengage the motor connection means 26 from the wrapping shaft 10, such as by operation of the lever 34 to manually exert pressure in a preselected direction to hingedly move the motor 30 and the surrounding motor mounting away from the second end 14 of the shaft. When pressure exerted on the lever 34, and therefore on the disengaging means 36, is released, the disengaging means 36 allows the motor connection 26 to re-connect the second end 14 of the wrapping shaft 10 to the motor 30, such as by hingedly rotating the motor 30 downwardly, such as on a hinge mechanism 38, towards the second end 14 of the shaft 10. In the embodiment of FIG. 13, the motor connection means 26 is a shaft retaining sleeve provided in the motor 30 that removeably and operably engages the second end 14 of the shaft 10. Preferably, the motor connecting means 26 is engaged and disengaged from the shaft 10 automatically, such as by electronically or pneumatically powered clutches, transmissions, switches, or other disengaging means 36 known to those skilled in the art. More preferably, the connecting means 26 permits selective powered rotation of the shaft in clockwise and counter clockwise directions to permit powered retrieval of fencing as well as powered distributing of fencing by the apparatus.

Figure 11:
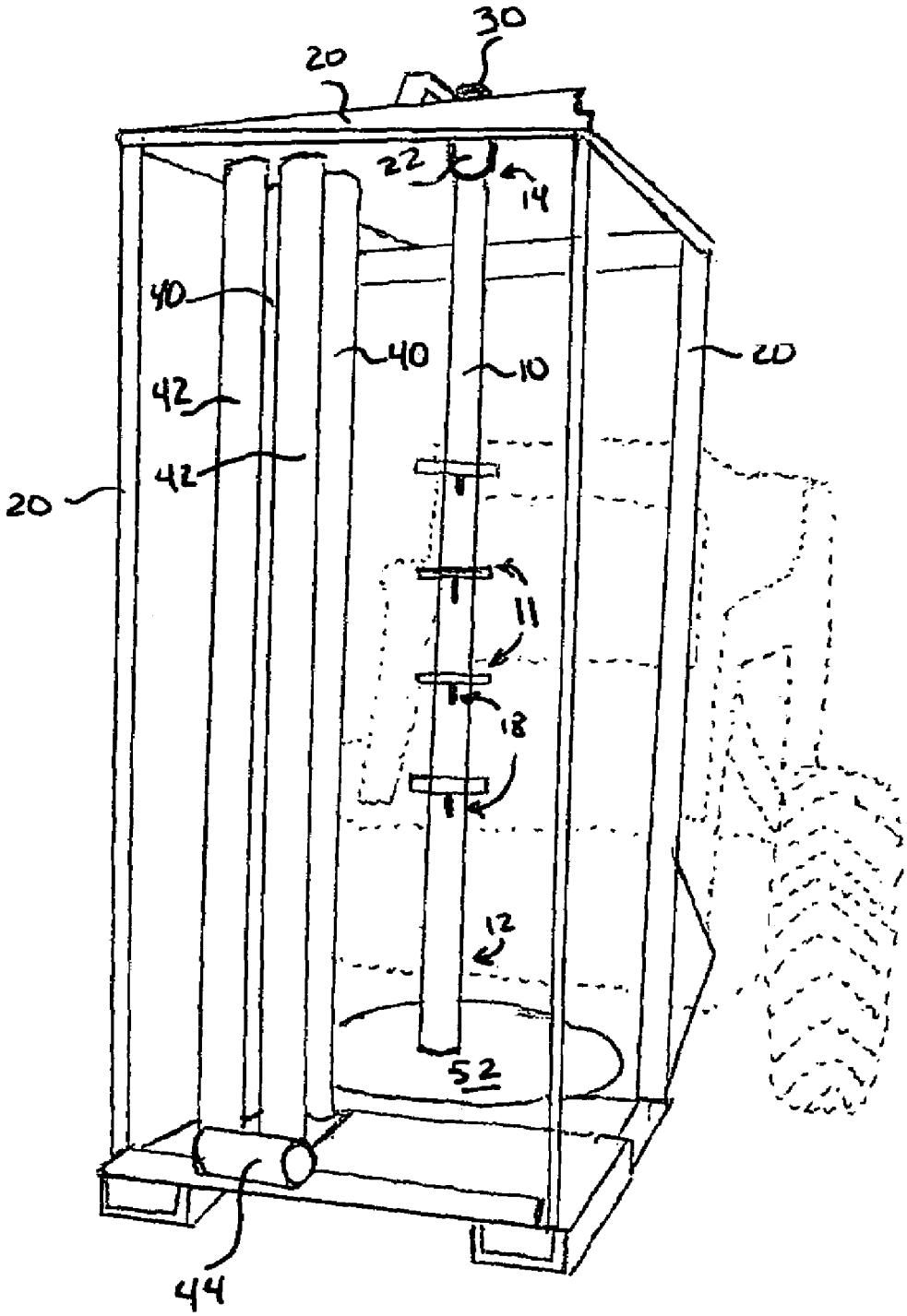
FIG. 11 illustrates a front perspective view of the apparatus in accordance with a second embodiment of the present invention mounted on a skid loader.
Figure 12:
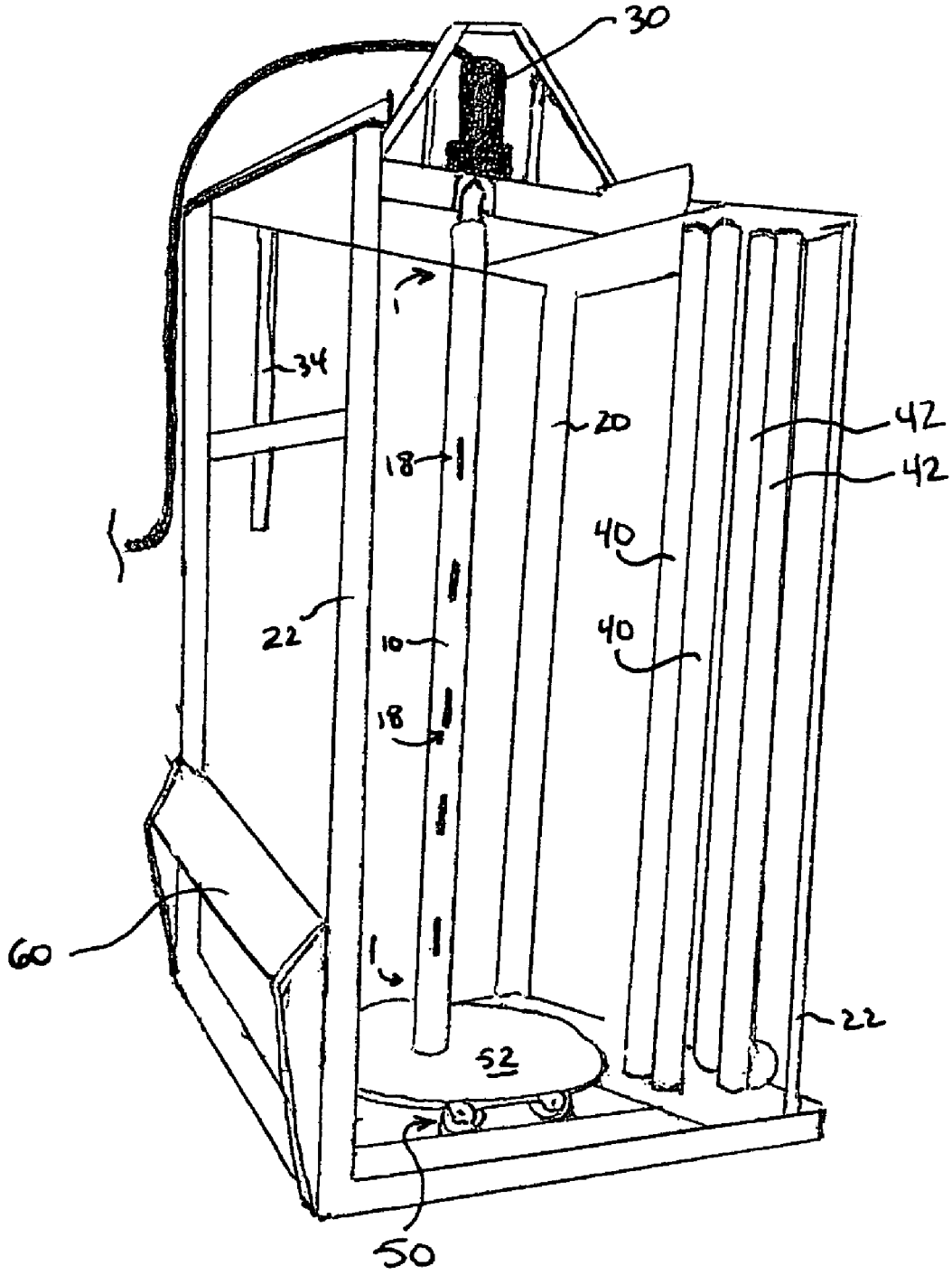
FIG. 12 illustrates a side perspective view of the apparatus of FIG. 11.
Figure 14:
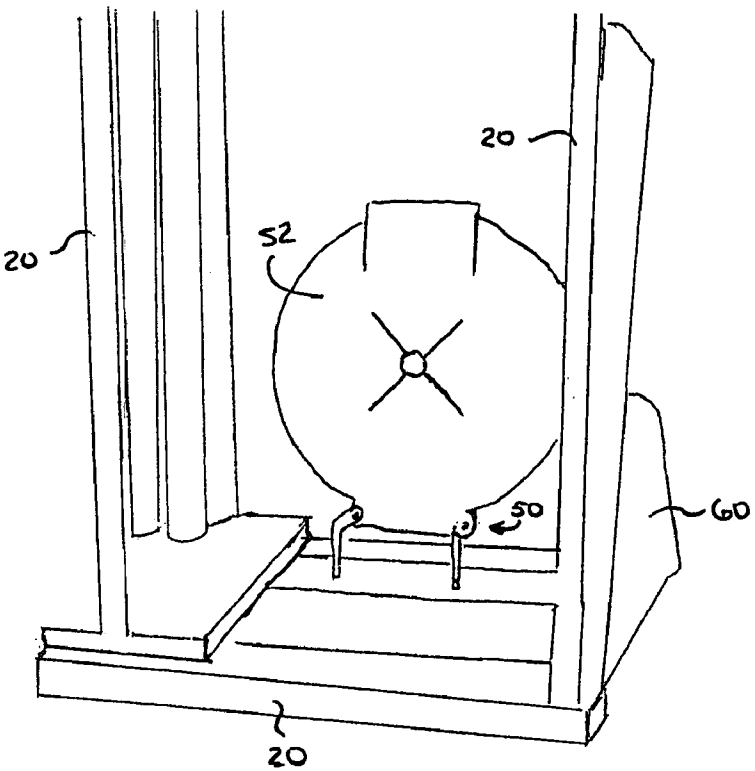
FIG. 14 illustrates an enlarged partial side perspective view of the apparatus of FIG. 11.

An advantage illustrated in the second embodiment is that multiple fencing materials, such as multiple strands of barbed wire can be rolled, and alternatively distributed, simultaneously without commingling of the fencing. As shown in FIG. 11, this can be accomplished using a minimal number of pins inserted into slots 18 provided in the wrapping shaft 10 to separate the spools of wire to be collected or distributed. The second embodiment requires fewer pins that a horizontal-shafted apparatus because the force of gravity on the spool keeps the spools from moving vertically along the shaft 10, thus eliminating the need to insert a pin above each spool. In contrast, the first embodiment requires more slots in the shaft 10 to permit rolling of multiple spools of fencing, since each spool requires a pin on either side of the spool to prevent migration of the spool horizontally along the shaft 10. In either embodiment, retaining means such as disks 11 can be slidably secured on the shaft 10, such as by pins inserted into slots 18, in order to separate fencing materials, and also to assist in substantially aligning fencing materials during retrieval or distributing operations.

Other advantages and features of the second embodiment illustrated in FIGS. 11–14 include the shaft hinge assembly 50 provided at the hinged end, here the first end 12, of the wrapping shaft 10. The hinged assembly 50 preferably comprises a disk 52 attached to the first end 12 that acts as a transportation stop for the fencing. The disk 52 may be permanently affixed to the shaft 10 such as by welding, or may be removeably affixed to the shaft 10 by removable retaining means such as by one or more pins, bolts, retaining pins, screws or the like inserted into holes or slots provided in the shaft 10. The hinged first end 12 further includes a shaft attachment to a shaft hinge assembly 50, which shaft hinge assembly 50 permits the shaft 10 to pivot from a vertical upright position (for rolling and distribution of fencing) to a horizontal or inverted position (for unloading or loading of rolled fencing). To pivot the shaft 10 on the shaft hinge assembly 50, the motor connection must first be disengaged from the second end 14 of the shaft 10 to allow the second end 14 to be unencumbered. As previously described, in the second embodiment illustrated in FIG. 13, disengagement of the shaft 10 is accomplished by operation of the lever 34 to exert force on the disengaging means 36 surrounding the motor 30 to move the means 36, such as on a hinge 38, away from the second end 14 of the shaft 10, thereby disconnecting the motor connecting means 26 from the shaft 10.

Preferably, the shaft hinge assembly 50 further includes a locking mechanism, such as a pin and loop, padlock, bar, or other locking means, that prevents the hinge from opening until the mechanism is removed or de-activated. With the shaft 10 unencumbered at the second end 14 and the hinge assembly 50 unlocked, the shaft 10 and disk 52 can be pivoted about the shaft hinge assembly 50 to a substantially horizontal position for loading and unloading of fencing materials. The shaft 10 can be pivoted manually, or by powered mechanism. In one embodiment, the supporting framework 20 incorporates a winch (not shown) having a cable attached to the shaft 10 proximate the unencumbered second end 14 of the shaft 10. In this embodiment, operating the winch to distribute or rewind the cable allows controlled pivoting of the shaft 10 to facilitate loading and unloading of rolled fencing.

As further illustrated in FIG. 11, the second embodiment preferably incorporates a supporting roller 44 that supports the lower end of vertically-oriented fencing, such as woven box fencing, as it passes through the guide rollers 42 and tensioning rollers 40 during rolling or distributing of fencing material using the apparatus. Preferably, the supporting roller 44 is substantially cylindrical in shape, and is axially rotatably mounted to the supporting framework 20 in substantially perpendicular orientation to the rollers 40, 42 and the shaft 10 such that the cylinder 44 freely rotates as the fencing rolls tangentially across the cylindrical surface of the roller 44. Preferably, the position of the supporting roller 44 can be vertically adjusted so as to support the lower end of vertically-oriented fencing as it passes across or between the guide rollers 42 and tensioning rollers 40.

The size and scale of the apparatus and its components are contemplated within a wide range in order to meet the needs of the fencing industry. For example, the apparatus may be provided with rollers and wrapping shafts approximately 4 feet wide in order to enable rolling of fences 4 feet high or less. Alternatively, taller embodiments having rollers in excess of 4 feet in length, such as for example, having shafts 10 between 4 feet and 12 feet long, allows for rolling of taller fences without the need for folding fencing. Optionally, the shaft 10 can include telescoping sections so that the length of the shaft 10 can be adjusted, such as to permit loading and unloading of rolled fencing onto the shaft 10. For example, the shaft may include nested telescoping sections that can be extended manually, pneumatically, hydraulically, and that can be fixed in the extended or retraced position by retaining pins placed into slots provided through the shaft sections, or by other known means.

Additionally, the inventors contemplate use of the apparatus to provide new and novel methods of rolling and distributing fencing. Aside from the novelty of using the disclosed apparatus having guide rollers and tensioning rollers, the methods contemplated by the inventors provide for rolling of fencing by folding of the fencing prior to uptake by the apparatus. For example, fencing taller than four feet can be rolled using embodiments of the apparatus having 4-foot long shaft 10 and rollers 40, 42. The method involves longitudinal folding of fencing to reduce the height of the fencing material prior to uptake by the apparatus. Preferably, the folding is performed so that substantially equal overlaps are created in the folded fencing material. For example, by folding a six-foot tall fence in half, a three-3 foot tall fence is provided for uptake by the apparatus. Using this method, the tensioning rollers 40 flatten the fencing for uptake on the wrapping shaft 10 to produce a tightly wound finished fencing roll approximately three feet tall. In another example, folding a nine-foot tall fence in thirds prior to uptake, the method will also produce a finished roll approximately three feet tall. Numerous other combinations can be made using this method to allow the rolling, or distribution, of fencing whose unrolled height exceeds the length of the shaft 10.

While the invention is described in terms of rolling or retrieving fencing, the apparatus and methods are equally applicable to rolling and distribution of any flexible material, including, but not limited to, fencing, wire, cable, flexible piping, hoses, and other elongated materials. For distribution, such as for stringing or hanging of fencing onto posts, rolls or spools of rolled fencing are placed on the wrapping shaft 10. With the motor 30 disengaged or in neutral, a length of the rolled fencing is unrolled and fed or threaded across or between the tensioning roller(s) 40 and any guide rollers 42 and support roller(s) 44. The leading edge of the fencing is then attached to a fencepost. To tension the fence, the motor 30 is engaged and locked or powered to resist rotation of the shaft 10. Alternatively, or additionally, where two or more opposed tensioning rollers 40 are provided, tension can be applied during fencing distribution by increasing tension on the fencing passing between the tensioning rollers 40, such as by moving the tensioning rollers 40 closer together or by adjusting the rotational resistance through known means such as belts, rollers, and the like contacting the rollers 40. Optionally, the tensioning rollers 40 may be powered, such as a by the motor 30 or by a second motor (not shown), to allow selected powered rotation, preferably in synchrony with the rotation of the wrapping shaft 10, during rolling or distribution of fencing. Additionally, while the fencing is being rolled or distributed, the skid loader, tractor, or other motorized vehicle attached to the apparatus can be easily maneuvered to tension or un-tension the fencing, as well as to increase or decrease the length of fencing in front of the apparatus to allow positioning of the fencing prior to hanging or rolling.

Lastly, although the apparatus has been described in two preferred embodiments, a first horizontal embodiment, and a second vertical embodiment, the apparatus can be configured to allow mounting in either orientation. For example, the framework 20 can include a plurality of mounting means 60, at least one mounting means 60 configured for vertically orienting the apparatus and shaft 10, and at least one additional mounting means 60 configured for horizontally vertically orienting the apparatus and shaft 10.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for automated rolling and distribution of flexible elongated fencing material, the apparatus comprised of:

a supporting framework, the framework comprising means for attachment to the lift mechanism of a motorized vehicle;

a motor;

a vertically mounted wrapping shaft having a first and an opposite second end, the first end mounted to the supporting framework by mounting means that permit pivoting of the wrapping shaft about the first end, the second end removably connected to the motor for powered rotation of the wrapping shaft by the motor; and, at least two opposed tensioning rollers, the at least two opposed tensioning rollers each being substantially cylindrical with each roller having convex outer surfaces for contacting and exerting force on fencing material inserted between the rollers, the at least two opposed tensioning rollers each rotatably and adjustably mounted to the supporting framework in substantially parallel orientation to the at least one vertically mounted wrapping shaft to permit dispensing and retrieval of both single stranded and screen fencing material.

2. The apparatus of claim 1, wherein the means for attachment of the supporting framework further includes a mounting plate disposed for attachment to the lift mechanism of a motorized vehicle.

3. The apparatus of claim 1, wherein the wrapping shaft and the at least two opposed tensioning rollers are axially mounted in substantially vertical orientation.

4. The apparatus of claim 1, wherein the mounting means are comprised of a hinge assembly.

5. The apparatus of claim 1, wherein the supporting framework is further comprised of at least one guide for vertical positioning of the flexible fencing material during powered rotation of the wrapping shaft.

6. The apparatus of claim 5, wherein the at least one guide is comprised of at least one support roller for positioning of the flexible fencing material during powered rotation of the wrapping shaft.

7. The apparatus of claim 1, wherein the at least two opposed tensioning rollers are adjustably mounted to the supporting framework to permit adjustment of contact and force exerted between the opposed tensioning rollers.

8. The apparatus of claim 1, wherein the at least two opposed tensioning rollers are comprised of two pairs of opposed tensioning rollers.

9. The apparatus of claim 1, wherein the pair of adjustably mounted opposed tensioning rollers are mounted using dynamic tensioning means that permit adjustment of contact and force exerted between the opposed tensioning rollers.

10. The apparatus of claim 9, wherein the dynamic tensioning means is selected from the group consisting of spring-loaded roller mountings, pneumatic roller mountings, and hydraulic roller mountings.

11. The apparatus of claim 1, wherein the wrapping shaft further includes means for simultaneously rolling a plurality of flexible elongated materials without co-mingling the materials.

12. The apparatus of claim 11, wherein the means for simultaneously rolling a plurality of flexible elongated materials comprises retaining means located at preselected intervals along the wrapping shaft.

13. The apparatus of claim 12, wherein the retaining means are removable.

14. The apparatus of claim 13, wherein the retaining means comprise a retainer selected from the group consisting of pins, screws, bolts, bars, and tabs, the retainer adapted for removable insertion into at least one aperture provided in the wrapping shaft.

15. The apparatus of claim 14, wherein the at least one aperture provided in the wrapping shaft penetrates through the shaft, and wherein the axis of each of the at least one aperture is substantially perpendicular to the longitudinal axis of the wrapping shaft.

16. The apparatus of claim 14, wherein the retaining means further includes at least one disk adapted for slidable mounting on the wrapping shaft, the at least one disk further adapted for engaging the retainer so as to support rolled flexible material during operation of the apparatus.

17. A method of rolling flexible elongated material, the method comprised of the steps of:

providing at least one unrolled elongated flexible material;

providing an apparatus, the apparatus comprising:

a supporting framework;

a motor mounted to the supporting framework;

a wrapping shaft vertically and pivotally mounted to the supporting framework, the wrapping shaft removably connected to the motor for selected powered rotation of the wrapping shaft; and, at least two opposed tensioning rollers, the at least two opposed tensioning rollers rotatably and adjustably mounted to the supporting framework in substantially parallel orientation to the at least one vertically mounted wrapping shaft, each roller having a convex outer surface for contacting and exerting force on fencing inserted between the rollers;

threading an unencumbered edge of the least one elongated flexible material between the at least two opposed tensioning rollers;

removably attaching the unencumbered edge to the wrapping shaft; and operating the motor to engage and rotate the wrapping shaft so as to retrieve and flatten the unrolled flexible material and roll the material around the rotating shaft.

18. The method of claim 17, wherein the at least one flexible elongated material is selected from the group consisting of fencing, wire, cable, and flexible piping.

19. The method of claim 18, further comprised of the step of adjusting tension on the at least one flexible elongated material by adjusting the tension of at least one of the tensioning rollers.

20. The method of claim 19, further comprised of the step of folding the flexible elongated material along at least one longitudinal axis prior to the step of threading a leading edge of the elongated flexible material between the tensioning rollers.

21. A method of distributing rolled flexible elongated material, the method comprised of the steps of:

providing rolled elongated flexible material;

providing an apparatus, the apparatus comprising:

a supporting framework;

a motor mounted to the supporting framework;

a wrapping shaft vertically and pivotally mounted to the supporting framework, the wrapping shaft removably connected to the motor for selected powered rotation of the wrapping shaft; and, at least two opposed tensioning rollers, the at least two opposed tensioning rollers rotatably and adjustably mounted to the supporting framework in substantially parallel orientation to the at least one vertically mounted wrapping shaft, each roller having a convex outer surface for contacting and exerting force on fencing inserted between the rollers;

placing the rolled flexible material on the wrapping shaft;

threading an unencumbered edge of the least one elongated flexible material between the at least two opposed tensioning rollers;

applying tension to the leading edge; and operating the motor to rotate the wrapping shaft so as to distribute the rolled flexible material.

22. The method of claim 21, wherein the flexible elongated material is selected from the group consisting of fencing, wire, cable, and flexible piping.

23. The method of claim 21, further comprised of the step of adjusting tension on the flexible elongated material by adjusting the tension of at least one of the tensioning rollers.

* * * * *